United States Patent [19]

Gleckler et al.

[11] Patent Number: 4,772,068

[45] Date of Patent: Sep. 20, 1988

[54] ADJUSTABLE FISHING AND CAMPING CHAIR

[76] Inventors: Robert C. Gleckler, 2450 Pepperwood Ave., Long Beach, Calif. 90815; David W. Gleckler, 3527 Kallin Ave., Long Beach, Calif. 90808

[21] Appl. No.: 297,059

[22] Filed: Aug. 27, 1981

[51] Int. Cl.[4] ..... A47C 4/00

[52] U.S. Cl. ..... 297/39; 297/325; 248/188.5

[58] Field of Search ..... 297/39, 35, 38, 325; 248/188.5

[56] References Cited

U.S. PATENT DOCUMENTS

| | | | |
|---|---|---|---|
| 2,615,499 | 10/1952 | Wallace | 297/325 |
| 2,731,072 | 1/1956 | Post | 248/188.5 X |
| 2,871,921 | 2/1959 | Arnold | 297/39 |
| 3,094,358 | 6/1963 | Hartman | 297/39 X |
| 3,947,140 | 3/1976 | Thomas | 248/188.5 |

FOREIGN PATENT DOCUMENTS

| | | | |
|---|---|---|---|
| 548903 | 7/1956 | Belgium | 297/39 |
| 514038 | 2/1955 | Italy | 297/39 |
| 829937 | 3/1960 | United Kingdom | 297/35 |

*Primary Examiner*—Francis K. Zugel
*Attorney, Agent, or Firm*—Charles H. Thomas

[57] ABSTRACT

A camping and fishing chair is provided which includes means at the rear of the chair for shortening the distance between the bottom of the chair and the surface on which it rests whereby the same may be adapted for use on an incline and the chair also includes means for selectively adjusting the front of the chair so that the chair may also be used on an incline by raising or lowering the front portion.

3 Claims, 2 Drawing Sheets

43
45
44
38
42
46
47
43
47
48
40
40
36
52
54
39
41
50
46
42a
53
38
54
50
37
53
48

43
47
46
54'

48
52
49
51
53
50
54

ADJUSTABLE FISHING AND CAMPING CHAIR

This invention relates to accessories for fishermen, and more particularly, to an adjustable fishing and camping chair.

It is the principal object of this invention to provide an adjustable fishing and camping chair, which will be adaptable for use by fishermen, campers and anyone who needs a chair for use on an incline.

Another object of this invention is to provide an adjustable fishing and camping chair, which will be of such structure so as to remain level on slopes around the shores of most lakes, and on rolling hills or uneven ground.

Another object of this invention is to provide an adjustable fishing and camping chair, which will have three-position adjustable rear legs, for inclines up to approximately twenty degrees.

Another object of this invention is to provide an adjustable fishing and camping chair, which will fold flat for easy carrying, storage and packing.

A further object of this invention is to provide an adjustable fishing and camping chair, which will be quickly and easily adjustable, and will be safe in use.

Other objects of the present invention are to provide an adjustable fishing and camping chair, which is simple in design, inexpensive to manufacture, rugged in construction, easy to use and efficient in operation.

These, and other objects, will be readily evident, upon a study of the following specification, and the accompanying drawings, wherein.

Figures 1, 2, 3, 4, 5, 6:
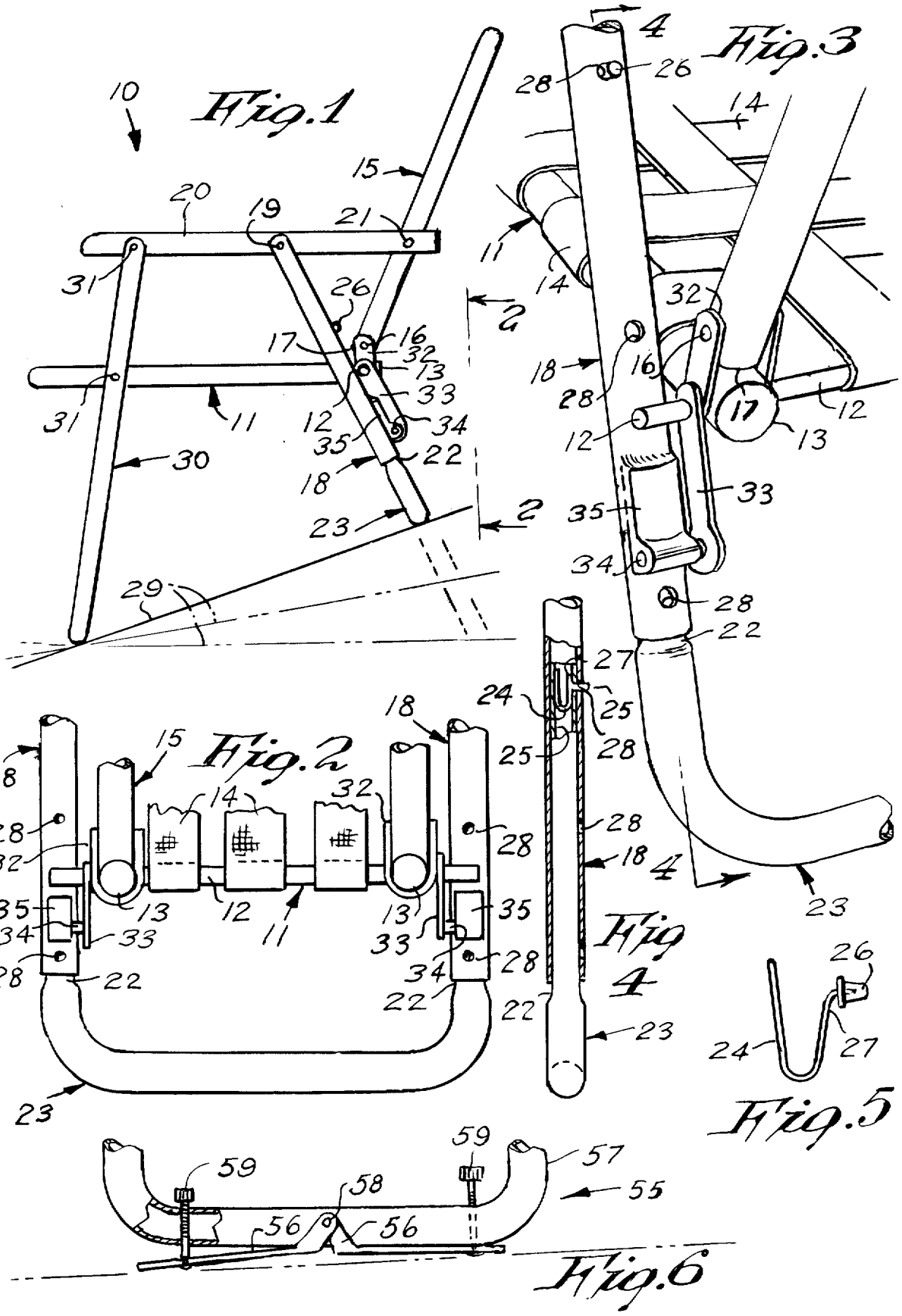
FIG. 1 is a side view of the present invention, showing various slope grades, two of them being illustrated in phantom.
FIG. 2 is an enlarged fragmentary rear elevational view of FIG. 1.
FIG. 3 is an enlarged fragmentary perspective view of a portion of FIG. 1.
FIG. 4 is a vertical cross-sectional view, taken along the line 4—4 of FIG. 3.
FIG. 5 is an enlarged plan view of the spring member, shown removed from FIG. 4.
FIG. 6 is a fragmentary side elevational view of a modified form of leg, with adjustment means for the chair, when it is placed transversely on a slope.

According to this invention, a chair 10 is shown to include a tubular seat frame 11, of "U"-shaped configuration, having a rod 12 extending transversely through its ends 13. Frame 11 is covered with suitable webbing material 14, which serves as comfortable seat means for the user. A backrest frame 15, of similar shape as frame 11, includes a pin 16 at each end 17, which is received transversely therethrough, for a purpose, which hereinafter will be described. Frame 15 is also covered with webbing material 14, for providing comfortable backrest means for the user. A pair of tubular rear leg members 18, one on each side of frame 11, are secured, by suitable fasteners 19, to the outside surfaces of a pair of armrest members 20, which are secured to the sides of frame 15, by means of suitable fasteners 21. Leg members 18 telescopingly receive the ends 22 of a "U"-shaped extension 23, and a leaf spring 24 is fixedly secured, in a suitable manner, at one side, to the inner periphery 25 at the ends of extension 23. Spring 24 includes a tapered button 26, fixedly secured to its free end 27, for being freely and removably received in any of the equally spaced-apart openings 28 through the respective leg members 18, so as to adjust the tubular seat frame 11 to a substantially level position, with regard to the various degrees of ground 29 slope. The front leg member 30 is also of tubular and "U"-shaped configuration, and is pivotally secured to frame 11 and armrest members 20, by suitable fasteners 31, so as to enable chair 10 to be folded for carrying and storage.

Pin 16 is secured in an end of a pair of brackets 32, which are pivotally held, at their opposite ends, to rod 12 of frame 11, and the ends of rod 12 are pivotally received in one end of the arms 33, which are fixedly secured, at their opposite ends, to a pin or bolt 34, that is pivotally received in one end of a plate 35, which is suitably welded or otherwise secured to the outside of members 18, so as to provide freedom of movement for extension 23 within members 18. The members 32, 12, 16, 33, 34 and 35 provide folding means for the rear portions of chair 10, and the extending ends of rod 12 serve as stop means, against the outer periphery of leg members 18, when chair 10 is unfolded for use.

In use, chair 10 is first unfolded, and the level of the frame 11, which is the seat portion, is maintained for the various degrees of slope of ground 29, by the user urging buttons 26 inwards, while gently pulling up, or pushing down, the extension member 23, for easy adjustment. The button 26 will remain inward, until the next opening 28 is reached. When this occurs, button 26 will snap out in the opening 28, thus locking extension member 23 in place.

Figure 7:
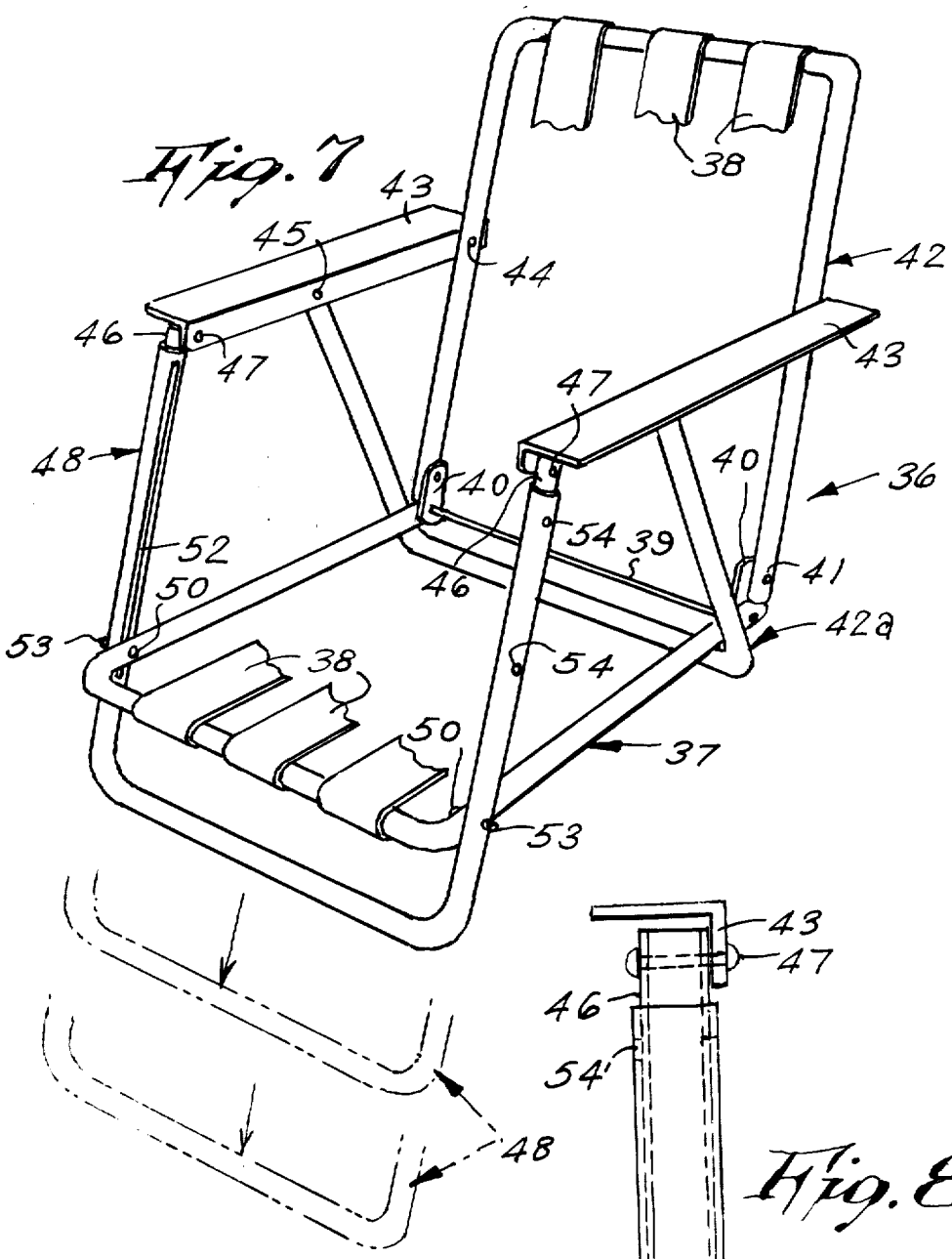
FIG. 7 is a fragmentary perspective view of a low profile chair, forming a part of the present invention, and incorporating a front extendible leg.
Figure 8:
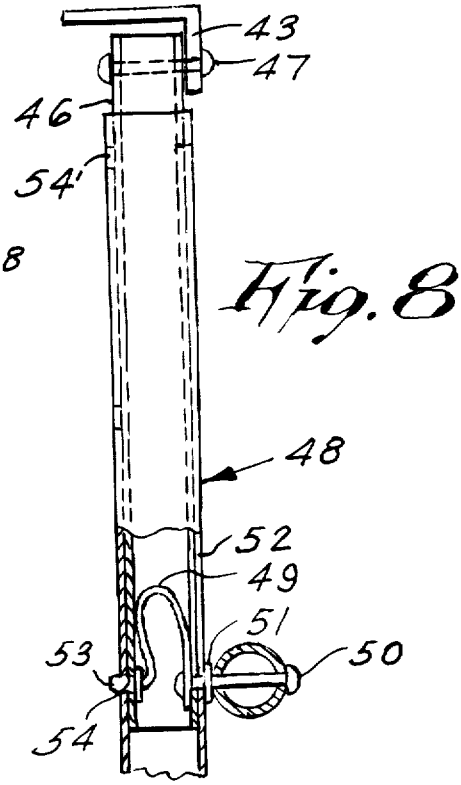
FIG. 8 is an enlarged front elevational view of one of the post assemblies of the front leg illustrated in FIG. 7.

Referring now to FIGS. 7 and 8 of the drawings, a modified chair 36, of low profile, includes a tubular and "U"-shaped seat frame 37, covered by means of suitable webbing 38. A rod 39 is received in one end of each of a pair of arms 40, and the opposite ends of arms 40 are pivotally received on a fastener 41, secured fixedly in each end of a tubular and "U"-shaped frame 42, which is also covered by webbing 38. A pair of armrest members 43, of "L"-shaped cross-sectional configuration, are secured pivotally at one end, to the sides of frame 42, by suitable fasteners 44, and the ends of a tubular and "U"-shaped leg member **42*a* are secured pivotally to armrest members 43, by means of suitable fasteners 45, the bottom portion of leg member 42*a* being in engagement with the bottom of frame 37 and the ground surface, when chair 36 is in use. A pair of tubular members 46 are pivotally secured, at one end, to the front ends of armrests 43, by means of suitable fasteners 47, and members 46 are telescopingly received in the ends of a tubular and "U"-shaped member 48. A leaf spring 49 is fixedly secured, at one side, in the lower portions of tubes 46, by a fastener 50, which also secures the front end of frame 37 against a spacer 51, that is slideably received against the outer periphery of front leg member 48. Fasteners 50 are also slideably received in an elongated slot 52 in the side portions of leg member 48. The free end of spring 49, in each tube 46, includes a button 53, which is removable received in any one of a plurality of equally spaced-apart openings 54, through leg member 48**.

In use, chair 36 is unfolded, until the leg members **42*a* and 48 are fully extended, the bottom portions touching the ground surface. The seat frame 37 is placed in a substantially level position with respect to the degree of slope of the ground surface, by urging in the buttons 53, and sliding leg member 48 up or down on the tubes 46, until the desired openings 54 are in position, and the buttons will then snap into the openings 54, in the same manner as was heretofore described of chair 10**.

It shall be noted, that chair 36 folds flat for easy carrying and storage, as does the structure of chair 10, and each of the structures includes three elevatable positions.

Referring now to FIG. 6 of the drawings, a modified leg structure 55 is shown to include a pair of oppositely opposed and adjustable arms 56, which are pivotally secured to the side and center of a "U"-shaped leg member 57, by means of suitable fastener 58. A pair of set screw fasteners 59 are threadingly received through member 57, and are anchored to, and near, the outer ends of arms 56, by suitable means.

In use, arms 56 are elevated or lowered on either side of fastener 58, by rotating the screws 59 until leg 55 is level with respect to its chair placement, transversely on a slope.

What we now claim is:

1. A folding camping and fishing chair constructed of a seat member, a back member pivotally secured to said seat member, arm members pivotally secured to said back member, and pairs of front and rear legs pivotally connected to said arm members, the legs of at least said front pair of which are formed with a pair of hollow, telescoping, inner and outer elements having tubular walls, and said outer elements are formed with a substantially "U"-shaped tubular front leg member, the ends of which are longitudinally slotted and have a plurality of longitudinally aligned openings defined through the walls thereof, and said inner elements are formed as a pair of tubes pivotally connected to said arm members and telescopically received in said slotted ends of said tubular front leg member, and each inner element has an aperture defined through the wall thereof, and a spring is mounted within each of said tubes of each of said inner elements, and locking buttons are mounted on each of said springs and are biased to project from the interior of said inner elements into said apertures and through any opening in an outer element which is aligned therewith, and coupling means comprised of fasteners which pass through the slots in said ends of said front leg member to join said inner leg elements to said seat member, and pivotally couple said front pair of legs to said seat member so as to allow longitudinal movement of said inner elements in said outer elements.

2. A folding camping and fishing chair constructed of a seat member comprised of a tubular, substantially "U"-shaped seat frame, a pair of spaced apart substantially "U"-shaped brackets rigidly secured to the rear end of said seat member and having openings defined therethrough, a back member, a rod extending transversly through said openings in said "U"-shaped brackets to pivotally secure said back member to said seat member, arm members pivotally secured to said back member, and pairs of front and rear legs pivotally connected to said arm members, wherein said rear pair of legs is formed of a pair of hollow telescoping, inner elements which are defined by the ends of a substantially "U"-shaped rear leg member, both of said ends having apertures defined through the walls thereof, a spring mounted within each of said inner elements, and locking buttons mounted on each of said springs and biased to project from the interior of said inner elements into said apertures, a pair of outer elements which are straight leg members pivotally connected to said arm members and each having a plurality of longitudinally aligned openings defined through the walls thereof, whereby said locking buttons project through any opening in an outer element which is aligned with an aperture in said inner element, coupling means in the form of a pair of link arm means having first ends coupled to said outer elements of said leg members to pivotally couple said rear pair of legs to said seat member so as to allow freedom of movement of said inner elements in said outer elements, and both ends of said rod extend beyond said seat member through second ends of said link arm means and therebeyond to engage the outer periphery of said hollow straight leg members so as to serve as stop means for holding said seat frame and said back members stationary when said chair is unfolded for use, and further comprising a pair of transversly extending arms which are pivotally secured to the sides of the bottom of said "U"-shaped rear leg member at the center thereof, and which extend outwardly therefrom, and a pair of vertically disposed adjustable set screws are threadablly engaged with said bottom of said "U"-shaped rear leg member on either side of the center thereof, and are anchored to said transversly extending arms.

3. A folding camping and fishing chair constructed of a seat member comprised of a "U"-shaped seat frame having rearwardly extending open ends, a back member pivotally secured to said seat member, arm members pivotally secured to said back member and pairs of front and rear legs pivotally connected to said arm members, the legs of at least the front pair of which are each formed of a pair of hollow telescoping, inner and outer elements having tubular walls, and said outer elements each have a plurality of longitudinally aligned openings defined through the wall thereof and said inner elements each have an aperture defined through the wall thereof, and a spring is mounted within each of said inner elements, and locking buttons are mounted on each of said springs and are biased to project from the interior of said inner elements into said apertures and through any opening in an outer element which is aligned therewith, and coupling means pivotally couple said front pair of legs to said seat member so as to allow freedom of movement of said inner elements in said outer elements, and said rear pair of legs is formed of a "U"-shaped leg member pivotally secured at its ends to the center portions of said arm members by fasteners so as to fold, and said open ends of said seat frame rest on the bottom portion of said rear leg member when said chair is in use.

* * * * *